US009169668B2

(12) United States Patent
George

(10) Patent No.: US 9,169,668 B2
(45) Date of Patent: Oct. 27, 2015

(54) MORTISE LOCK CONVERSION KIT FOR OPERATION WITH AN AMERICAN CYLINDER

(75) Inventor: Timothy Vincent George, Smithfield, UT (US)

(73) Assignee: Hopper Holding AG, Müstair (CH)

( * ) Notice: Subject to any disclaimer, the term of this patent is extended or adjusted under 35 U.S.C. 154(b) by 325 days.

(21) Appl. No.: 13/617,437

(22) Filed: Sep. 14, 2012

(65) Prior Publication Data

US 2014/0075728 A1 Mar. 20, 2014

(51) Int. Cl.

| | |
|---|---|
| ***E05B 9/04*** | (2006.01) |
| ***E05B 17/04*** | (2006.01) |
| ***E05B 63/00*** | (2006.01) |
| ***E05B 63/08*** | (2006.01) |
| ***E05C 21/00*** | (2006.01) |
| *E05B 1/00* | (2006.01) |

(52) U.S. Cl.

CPC ..... *E05B 17/04* (2013.01); *E05B 63/0056* (2013.01); *E05B 63/0065* (2013.01); *E05B 63/08* (2013.01); *E05C 21/00* (2013.01); *E05B 1/0015* (2013.01); *E05B 63/006* (2013.01); *Y10T 29/49716* (2015.01); *Y10T 70/8486* (2015.04)

(58) Field of Classification Search

CPC ... E05B 1/0015; E05B 17/04; E05B 63/0056; E05B 63/006; E05B 63/0065; E05B 63/08; E05C 21/00; Y10T 29/49716; Y10T 70/8486

USPC ..... 29/401.1; 70/449, 461, 466

See application file for complete search history.

(56) References Cited

U.S. PATENT DOCUMENTS

| | | | |
|---|---|---|---|
| 1,846,364 | A | 2/1932 | Schlage |
| 2,921,461 | A | 1/1960 | Schlage |
| 3,293,892 | A | 12/1966 | Falk |
| 4,576,023 | A | 3/1986 | Crepinsek |
| 5,474,348 | A | 12/1995 | Palmer et al. |
| 5,893,282 | A | 4/1999 | Runge et al. |
| 5,992,195 | A | 11/1999 | Huang et al. |
| 6,606,890 | B1 | 8/2003 | Widen |
| 7,475,578 | B2 | 1/2009 | Brown et al. |
| 2005/0011239 | A1 | 1/2005 | Lurie et al. |

FOREIGN PATENT DOCUMENTS

| | | |
|---|---|---|
| EP | 442384 | 8/1991 |

*Primary Examiner* — Ryan J Walters

(74) *Attorney, Agent, or Firm* — Reinhart Boerner Van Deuren P.C.

(57) ABSTRACT

The present disclosure includes a kit and method for operating or operably connecting an American locking cylinder into a European cylinder type mortise lock with the American locking cylinder functioning with the European cylinder mortise lock in place of the European locking cylinder itself. The present disclosure provides a door cylinder conversion kit that converts the European cylinder mortise lock to be operable with an American cylinder.

10 Claims, 4 Drawing Sheets

MORTISE LOCK CONVERSION KIT FOR OPERATION WITH AN AMERICAN CYLINDER

FIELD OF THE INVENTION

This disclosure relates generally to door locking systems, and more particularly to a mortise conversion kit configured for use with a door locking system.

BACKGROUND OF THE INVENTION

Windows and door markets typically have two primary main locking cylinders used to secure the windows and doors in a locked position. One such system is referred to as the American cylinder and the other system is referred to as the European cylinder. The European cylinder is also referred to as the Profile cylinder.

The American cylinder lock is widely used in the United States as a standard cylinder lock. It generally is small and mounts from behind the door hardware. A flat tail piece extends from behind the mechanism of the American cylinder lock and extends into a mortise receiver which is coupled to the internal locking system. The locking system typically drives a bolt into a door jamb (not shown) thus locking the door. The mortise may include a deadbolt and other latching mechanisms as determined by the manufacturer or user of the locking system.

In contrast to the American cylinder, the European cylinder typically has no tail piece and in order to accommodate different door thicknesses, an entire new locking cylinder must be manufactured and fitted to the locking system. Because there are different door thicknesses as manufactured by a variety of companies, so the different sized European cylinders must be manufactured and stocked. Accordingly, it would be advantageous to be able to convert a mortise lock system that accommodates a European cylinder to also be able to receive the American type cylinder regardless of the door thickness.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is desirable that all of the aforesaid advantages are achieved without incurring any substantial relative disadvantage.

The subject matter discussed in this background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

SUMMARY OF THE INVENTION

The present disclosure includes a kit and method for operating or operably connecting an American locking cylinder into a European cylinder type mortise lock with the American locking cylinder functioning with the European cylinder mortise lock in place of the European locking cylinder itself. The present disclosure provides a door cylinder conversion kit that converts the European cylinder mortise lock to be operable with an American cylinder.

A mortise lock that defines an orifice which provides access to a cam-toggle within the mortise lock housing. The orifice is configured to receive a mortise lock conversion kit. The mortise lock includes a cam-toggle defining a U-shaped engagement space, with the cam-toggle configured to engage a locking mechanism in the mortise lock.

The mortise lock conversion kit includes a conversion kit housing, with the housing defining a through bore. The conversion kit housing is coupled to the mortise lock in the orifice defined in the mortise lock housing. The orifice is configured to receive a mortise conversion hub. The mortise conversion hub has a first circular end and a second end which defines a rectangular portion. The mortise conversion hub also defines a slot extending through the hub, with the conversion hub configured to rotate within the through bore of the kit housing.

A mortise cam is coupled to the mortise conversion hub with the mortise cam defining a cam arm and a rectangular opening configured to receive the rectangular portion of the conversion hub. The mortise cam defines a fastener opening on each side of the rectangular opening with the cam arm configured to engage the cam-toggle in the U-shaped engagement space within the mortise housing. Two fasteners are configured to secure the mortise cam to the conversion hub when the conversion hub is disposed in the through bore of the conversion kit housing, with the mortise lock conversion kit configured to receive an American cylinder in the slot defined in the hub to operate the mortise lock.

In another embodiment the conversion kit housing may include a flange defined at one end of the kit housing, with the flange configured to restrict insertion of the kit housing beyond a predetermined depth in the mortise lock. The depth of insertion of the housing is configured to align the mortise cam with the cam-toggle within the mortise housing.

This disclosure relates to door locking systems, and particularly to a mortise conversion kit configured for use with a door locking system. The conversion kit housing is secured to the mortise lock housing, against rotation in the orifice of the mortise lock, by at least one fastener configured to engage a groove defined in the kit housing.

In a further embodiment, the mortise conversion hub defines an annular groove positioned between the first circular end and the second end with the annular groove configured to engage a set screw disposed through the kit housing and in communication with the through bore. The set screw is configured to restrict longitudinal movement of the conversion hub and allow rotational movement of the conversion kit within the through bore.

There is also provided a mortise lock conversion kit, with the mortise lock defining an orifice providing access to a cammed toggle defining a U-shaped engagement space, with the cam-toggle configured to engage a locking mechanism in the mortise lock.

The kit includes a conversion kit housing, with the housing defining a through bore. The through bore is offset radially from the central access of the kit housing. The conversion kit housing is coupled to the mortise lock housing in the orifice.

A mortise conversion hub is disposed in the through bore of the conversion kit housing. The hub includes a first circular end and a second circular end which defines a rectangular portion. The hub further defines a slot extending through the hub with the conversion hub configured to rotate within the through bore of the kit housing.

A mortise cam which defines a cam arm, a rectangular opening configured to receive the rectangular portion of the conversion hub and a fastener opening on each side of the rectangular opening is provided. The cam arm is configured to engage the cam-toggle in the U-shaped engagement space within the mortise lock housing. A pair of fasteners are configured to secure the mortise cam to the conversion hub with the conversion hub disposed in the through bore of the conversion kit housing. The mortise lock conversion kit is configured to receive an American cylinder to operate the mortise lock.

The mortise conversion hub defines an annular groove between the first circular end and the second end defining the rectangular portion. The annular groove is configured to engage a set screw through the kit housing. The set screw is configured to restrict longitudinal movement of the conversion hub and allow rotational movement of the conversion hub within the through bore.

There is also disclosed a method to convert a mortise lock for operation within an American cylinder. A mortise lock defines an orifice providing access to a cam-toggle which cam-toggle defines a U-shaped engagement space. The cam-toggle is configured to engage a locking mechanism in the mortise lock.

The method includes inserting a mortise conversion hub into a through bore defined in a conversion kit housing. The conversion hub defines a first circular end and a second end which defines a rectangular portion. The conversion hub further defines a slot extending through the hub.

A mortise cam is coupled to the conversion hub with a fastener in a fastener opening on each side of the rectangular opening defined in the mortise cam. The mortise cam defines a cam arm, with the rectangular opening configured to receive the rectangular portion of the conversion hub. The cam arm is configured to engage the cam-toggle in the U-shaped engagement space within the mortise lock housing.

The mortise conversion hub with the mortise cam is inserted into the orifice defined in the housing of the mortise lock. The conversion hub is configured to rotate within the through bore of the kit housing and the cam arm engaging the cam-toggle. The slot in the mortise conversion hub is configured to receive an American cylinder to operate the mortise lock. The flat tail piece of the American cylinder is inserted into the slot which upon rotation of the American cylinder, with a key, rotates the mortise conversion hub with the attached mortise cam which is engaged with the cam-toggle within the mortise lock housing.

The mortise conversion kit of the present invention is of a construction which is both durable and long lasting, and which will require little or no maintenance to be provided by the user throughout its operating lifetime. Finally, all of the aforesaid advantages are achieved without incurring any substantial relative disadvantage.

DESCRIPTION OF THE DRAWINGS

These and other advantages of the present disclosure are best understood with reference to the drawings, in which.

DETAILED DESCRIPTION OF THE EXEMPLARY EMBODIMENTS

There is disclosed a kit and a method for operating or operably connecting an American locking cylinder into a European cylinder type mortise lock with the American locking cylinder functioning with the European cylinder mortise lock in place of the European locking cylinder itself. The method and apparatus provides a door cylinder conversion kit 110 that converts the European cylinder mortise lock to be operable with an American cylinder 166.

Figure 1:
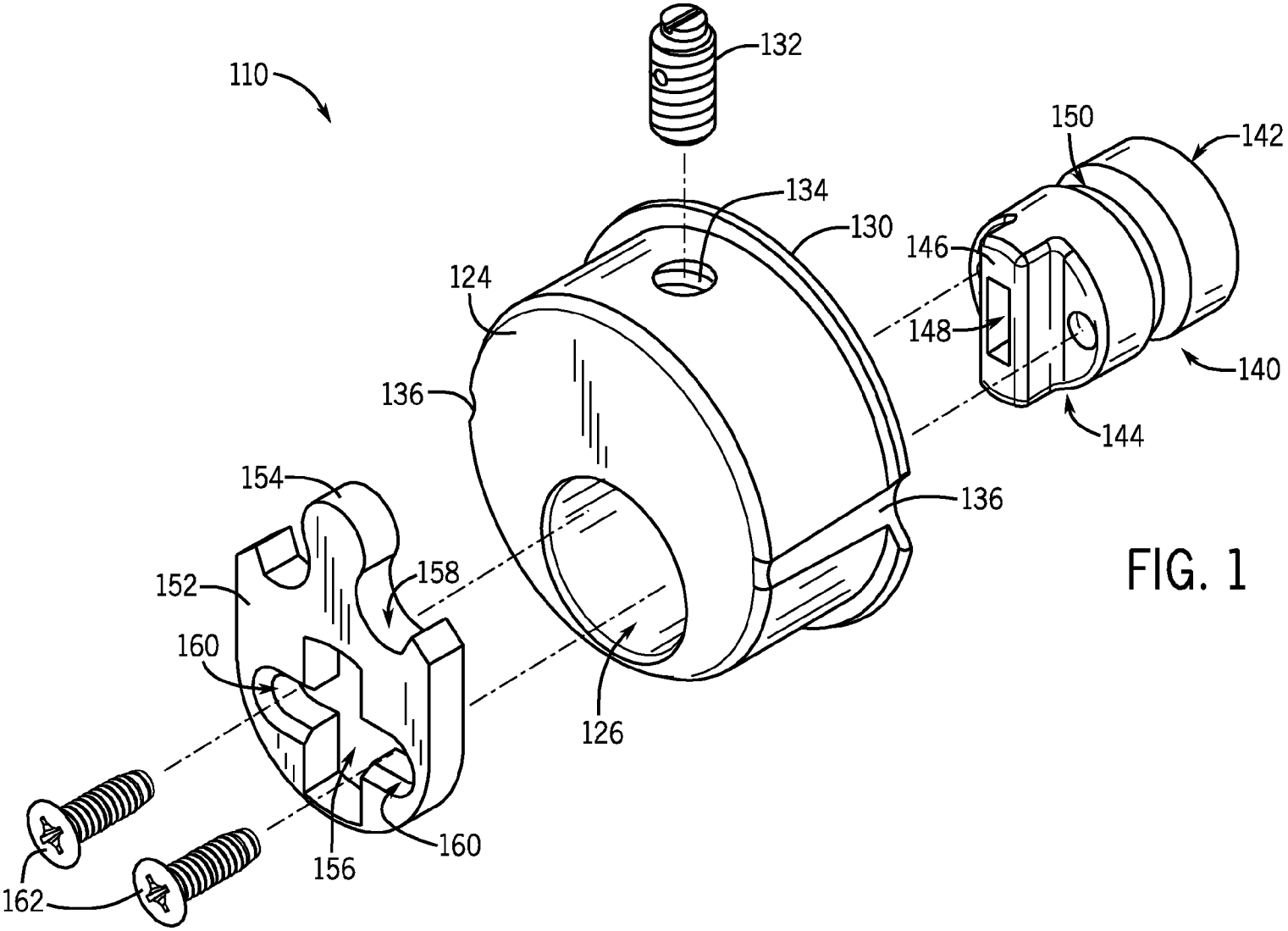
FIG. 1 is a perspective, exploded illustration of an exemplary embodiment of a mortise conversion kit.

Referring to the figures, FIG. 1 illustrates an exemplary embodiment of a mortise lock conversion kit 110. A conversion kit housing 124 typically is circular and defines a through bore 126. The through bore is configured to receive a mortise conversion hub 140. The through bore 126 is offset from the central axis of the conversion kit housing 124. The diameter of the conversion kit housing 124 is configured to allow the conversion kit housing 124 to fit in an orifice 164 defined in the mortise lock housing 114 (see FIG. 4).

Figure 4:
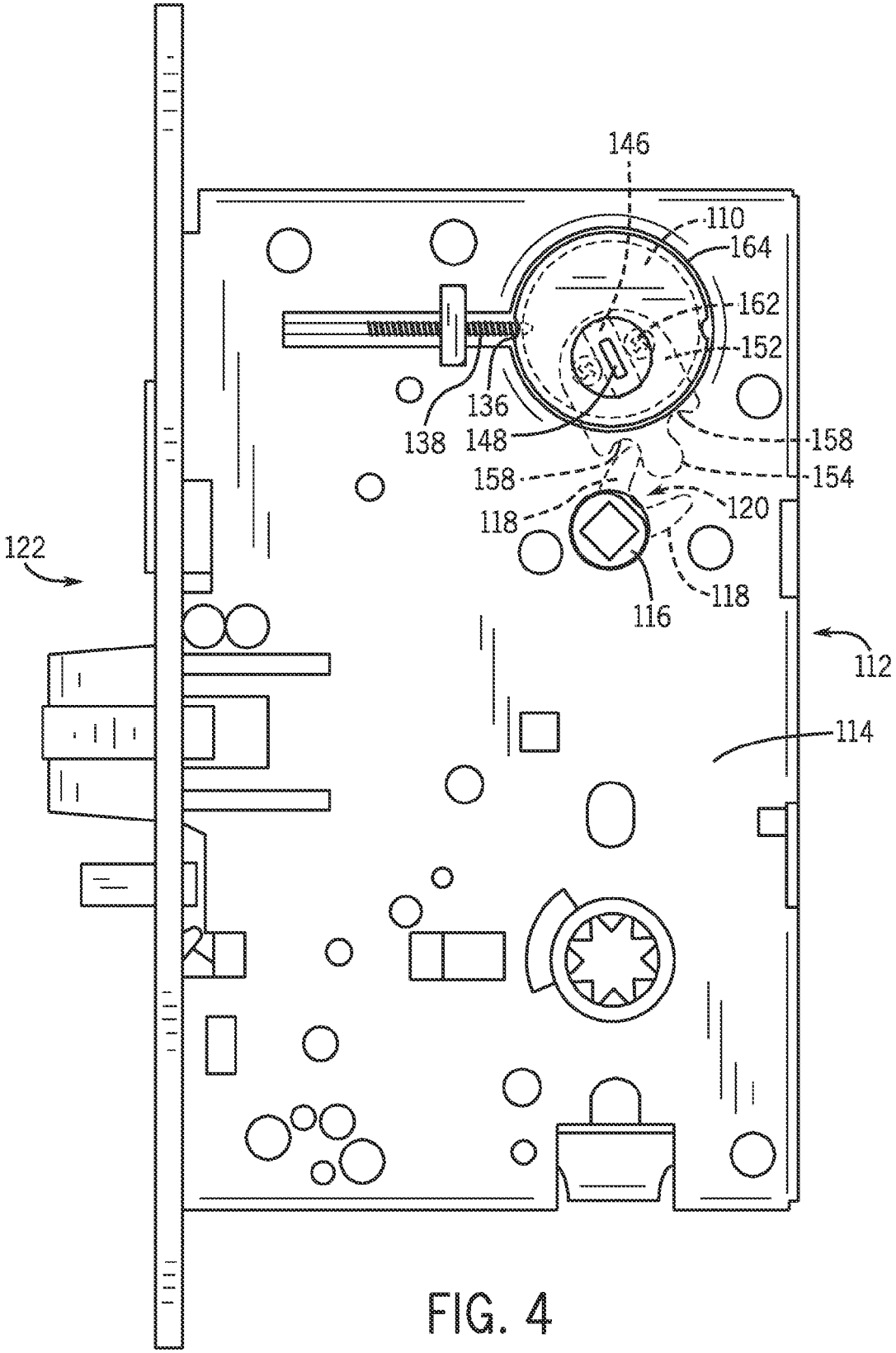
FIG. 4 is a plan view illustration of an exemplary embodiment of a European style mortise lock with the mortise conversion kit illustrated in FIG. 1 installed in an orifice in the mortise housing and coupled to a cam-toggle of a locking mechanism of the mortise lock illustrated in FIG. 3.

The conversion kit housing 124 also defines a flange 130 at one end of the housing 124. The flange 130 is configured to restrict insertion of the conversion kit housing 124 beyond a predetermined depth in the mortise lock orifice 164 defined in the mortise lock housing 114. The depth of insertion is to allow engagement with a cam-toggle 116 of the locking mechanism 122 (not shown) disposed in the housing 114 of the mortise lock 112. At least one groove 136 is defined in the conversion kit housing 124. The groove 136 is configured to receive a fastener 138 configured to secure the conversion kit housing 124 against rotation in the orifice 164 of the mortise lock 112. At least one fastener 138 can be used as illustrated in FIG. 4, however in some configurations two such fasteners 138 can be used.

The conversion kit housing 124 further defines a set screw opening 134 in the circumferential side portion of the housing 124 (see FIG. 1), with the set screw opening 134 in communication with the through bore 126. A set screw 132 is configured to threadingly engage the opening 134 and extend through the opening 124 to restrict longitudinal movement of a conversion hub 140 but allow rotation of the conversion kit 140 within the through bore 126.

A mortise conversion hub 140 is configured for insertion into the conversion kit housing 124 as described above. The mortise conversion hub includes a first circular end 142 and a second end 144. The second end 144 defines a rectangular portion 146. A slot 148 is defined in the mortise conversion hub 140 and extends throughout the length of the mortise conversion hub 140. The mortise conversion hub 140 further defines screw holes on each side of the rectangular portion 146 which are configured to receive fasteners 162 as described below. The mortise conversion hub 140 further defines an annular groove 150 positioned between the first circular end 142 and the second end 144. The annular groove 150 is configured to receive the set screw 132 through the conversion kit housing. As mentioned above, the set screw 132 restricts longitudinal movement of the conversion hub 140 but allows rotational movement of the conversion hub 140 within the through bore 126 with the set screw 132 riding within the annular groove 150.

A mortise cam 152 is configured for coupling to the mortise conversion hub 140. The mortise cam defines a cam arm 154 and a rectangular opening 156 configured to receive the rectangular portion 146 of the mortise conversion hub 140. The mortise cam 152 defines a rectangular opening 156 with a fastener opening 160 defined on each side of the rectangular opening 156. The rectangular opening is configured to receive the rectangular portion 146 of the mortise cam hub 140 with the mortise cam 152 secured to the mortise conversion hub 140 with a pair of fasteners 162 threadingly engaging screw holes defined in the mortise conversion hub 140 (see FIG. 1).

With the mortise cam 152 coupled to the mortise conversion hub 140 within the conversion kit housing 124 the mortise lock conversion kit 110 is inserted into the orifice 164 of the mortise lock 112. With the mortise lock conversion kit 110 positioned within the orifice 164 of the mortise lock 112, the cam arm 154 is positioned to engage the cam-toggle 116 disposed within the mortise lock housing 114 of the mortise lock 112 (see FIG. 4). The cam-toggle 116 defines a U-shaped engagement space 120 by a pair of protrusions 118. The protrusions 118 of the cam-toggle 116 engage concave depressions 158 defined in the mortise cam 152 with one concave depression 158 on each side of the cam arm 154. When the mortise conversion hub 140 is rotated (as described below) the attached mortise cam 152 is engaged with the cam-toggle 116 to operate the locking mechanism 122 in the mortise lock 112.

Figure 2:
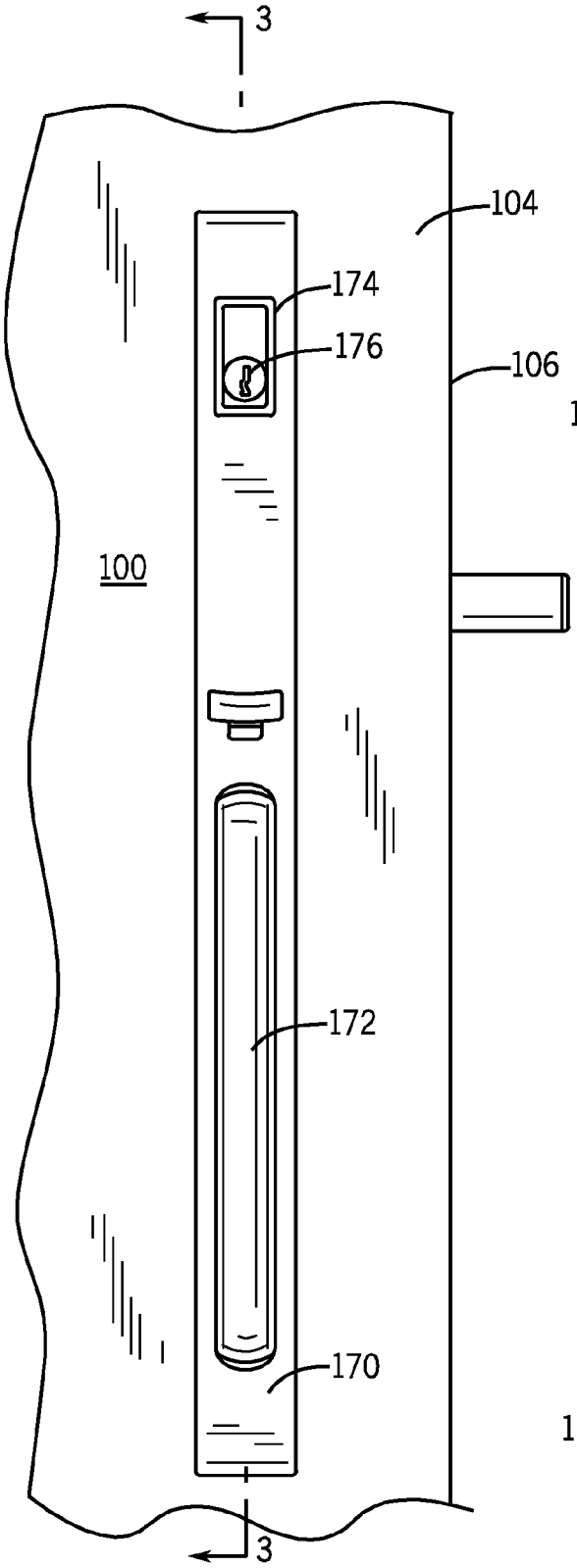
FIG. 2 is a plan view of a mortise lock installed in a door edge of a door, with the mortise lock including the mortise conversion kit illustrated in FIG. 1.
Figure 3:
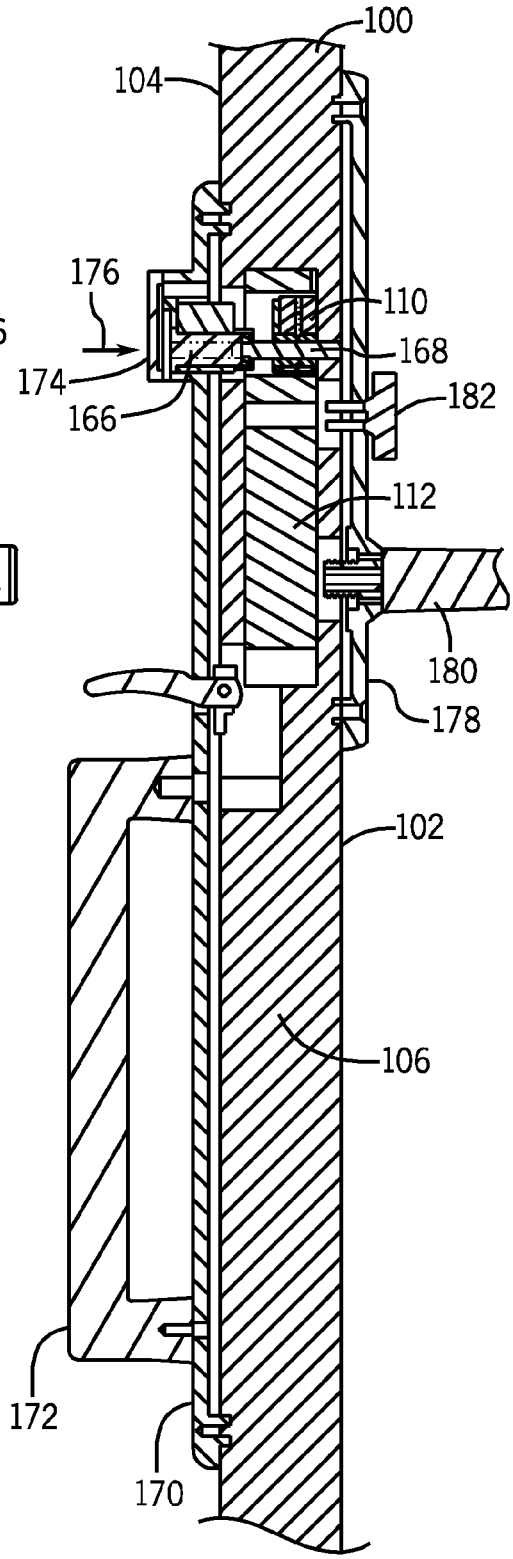
FIG. 3 is a cross-section of the mortise lock illustrated in FIG. 2 along line 3-3.
Figure 5:
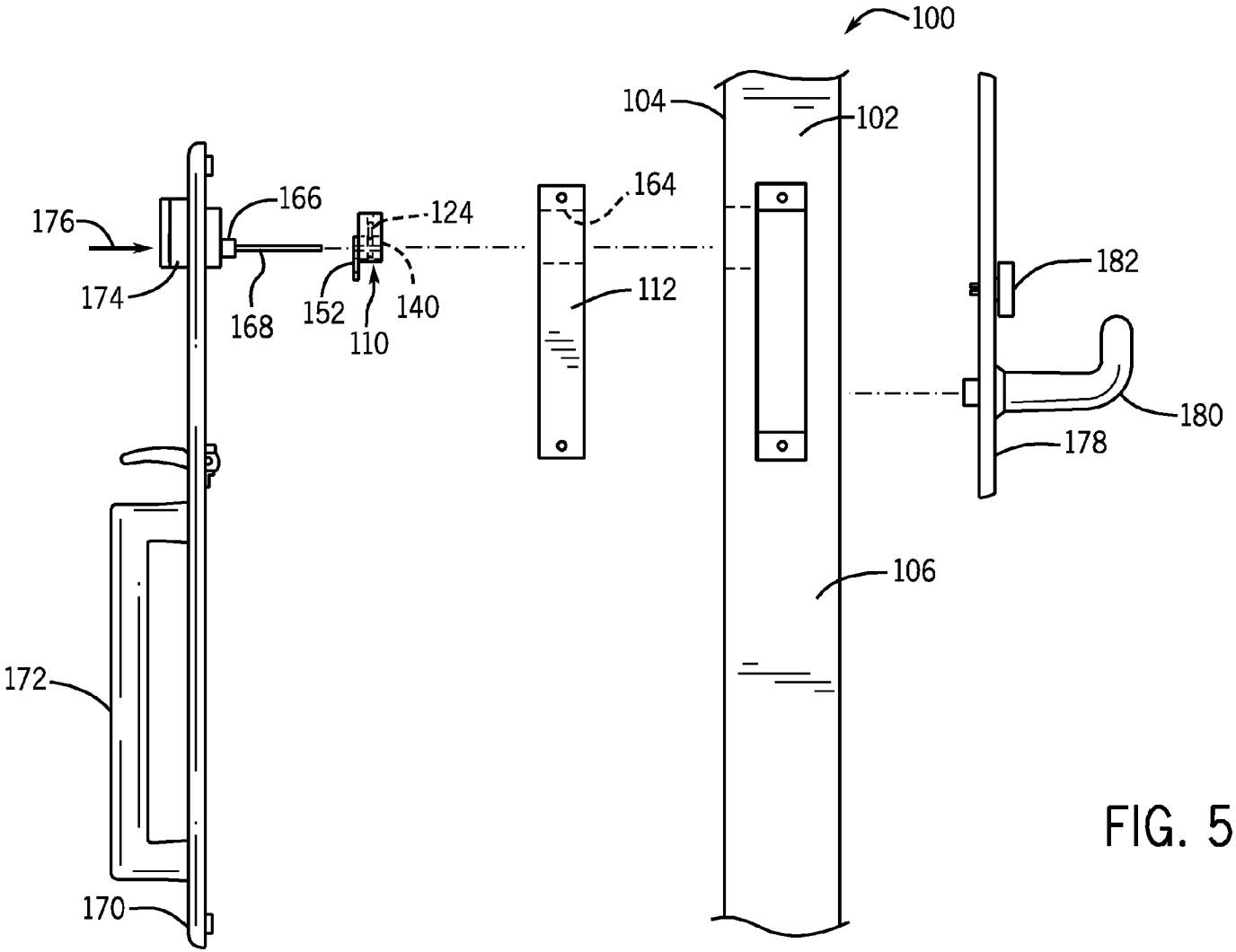
FIG. 5 is an exploded plan, side, illustration of the lock system illustrated in FIG. 3, including the mortise conversion kit illustrated in FIG. 1 and including an American cylinder with a flat tail piece.

Referring to FIGS. 2, 3, and 5, there is illustrated an arrangement of the mortise conversion kit 110 with the mortise lock 112 in a door 100. The door 100 includes one side 102 and another side 104 and a door edge 106. In a typical configuration, the mortise lock 112 is inserted into an opening defined in the door edge 106 with appropriate openings in both the one side and other side 102, 104 of the door 100. An American cylinder 166 is inserted into a cylinder casing 174 defined in the outside plate 170 of the door handle mechanism. The outside plate 170 typically also includes a handle 172 which in some configurations is fixed.

The American cylinder 166 includes a flat tail 168. The flat tail 168 may be of any appropriate length to operate in a particular door and door lock arrangement. The mortise lock conversion kit 110, as described above, is disposed in the orifice 164 of the mortise lock 112 with the flat tail 168 of the American cylinder 166 aligned with and installed in the slot 148 defined in the mortise conversion hub 140. A door inside plate 178 is coupled to one side 102 of the door 100 in such a manner as to secure the outside plate 170 with the inside plate 178 with appropriate fasteners to complete the handle and locking mechanism for the door 100. The inside plate typically includes a handle 180 that engages mechanisms within the mortise lock 112 for opening and closing the door and may include a deadbolt thumb turn 182 which is also coupled to the locking mechanism of the mortise lock 112.

In operation, when the user inserts a key into a keyhole 176 and turns the key the key teeth engage features within the American cylinder 166 (not shown) to allow rotation of the flat tail 168 which is positioned in the slot 148 of the mortise conversion hub 140. Rotation of the mortise conversion hub 140 within the through bore 156 of the conversion kit housing 124 rotates the affixed mortise cam 152 which is engaged with the cam-toggle 116 and operates the locking mechanism 122 within the mortise lock housing 114 of the mortise lock 112.

It should be understood that the system allows use with a variety of door thicknesses since the flat tail 168 of the American cylinder 166 can be cut to different lengths thus allowing the door locking assembly to accommodate a variety of door thicknesses without replacement of the entire door locking assembly. A further advantage is that the American cylinder is positioned inside the outside plate 170 thereby protecting it from the environment in which the door is located. It should also be understood that the sizing of the conversion kit housing 124 and its associated parts as described with respect to FIG. 1, can be of any dimension suitable for the intended door lock and mortise lock arrangement.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present mortise conversion kit mechanism has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the mechanism as described herein may be made, none of which depart from the spirit or scope of the present disclosure. The particular embodiments and applications were chosen and described to provide the best illustration of the principles of the mechanism and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A mortise lock conversion kit, with a mortise lock defining an orifice providing access to a cam-toggle defining a U-shaped engagement space, with the cam-toggle configured to engage a locking mechanism in the mortise lock, the kit comprising:

a conversion kit housing, the housing defining a through bore, the housing coupled to the mortise lock in the orifice;

a mortise conversion hub, the hub having a first circular end and a second end defining a rectangular portion, with the hub defining a slot extending through the hub, the conversion hub configured to rotate within the through bore of the kit housing;

a mortise cam, with the mortise cam defining a cam arm, a rectangular opening configured to receive the rectangular portion of the conversion hub, and a fastener opening on each side of the rectangular opening, the cam arm configured to engage the cam-toggle in the U-shaped engagement space; and a pair of fasteners configured to secure the mortise cam to the conversion hub when the conversion hub is disposed in the through bore of the conversion kit housing, with the mortise lock conversion kit configured to receive a tail of an American cylinder in the slot defined in the hub to operate the mortise lock.

2. The mortise lock conversion kit of claim 1, further comprising a flange defined at one end of the kit housing, with the flange configured to restrict insertion of the kit housing beyond a predetermined depth in the mortise lock.

3. The mortise lock conversion kit of claim 1, further comprising at least one groove defined in the kit housing, with the groove configured to receive a fastener configured to secure the kit housing against rotation in the orifice of the mortise lock.

4. The mortise lock conversion kit of claim 1, further comprising an annular groove defined in the mortise conversion hub between the first circular end and the second end defining the rectangular portion, with the annular groove configured to engage a set screw through the kit housing, with the set screw configured to restrict longitudinal movement of the conversion hub and allow rotational movement of the conversion hub within the through bore.

5. The mortise lock conversion kit of claim 1, further comprising a pair of concave depressions defined in the mortise cam, with one concave depression on each side of the cam arm, with each concave depression configured to receive a protrusion defined by the cam-toggle when the cam arm engages the cam-toggle in the U-shaped engagement space.

6. A mortise lock conversion kit, with a mortise lock defining an orifice providing access to a cam-toggle defining a U-shaped engagement space, with the cam-toggle configured to engage a locking mechanism in the mortise lock, the kit comprising:

a conversion kit housing, the housing defining a through bore, with the through bore offset radially from the center axis of the kit housing, the housing coupled to the mortise lock in the orifice;

a mortise conversion hub, the hub having a first circular end and a second end defining a rectangular portion, with the hub defining a slot extending through the hub, the conversion hub configured to rotate within the through bore of the kit housing;

a mortise cam, with the mortise cam defining a cam arm, a rectangular opening configured to receive the rectangular portion of the conversion hub, and a fastener opening on each side of the rectangular opening, the cam arm configured to engage the cam-toggle in the U-shaped engagement space; and a pair of fasteners configured to secure the mortise cam to the conversion hub when the conversion hub is disposed in the through bore of the conversion kit housing, with the mortise lock conversion kit configured to receive a tail of an American cylinder to operate the mortise lock.

7. The mortise lock conversion kit of claim 6, further comprising a flange defined at one end of the kit housing, with the flange configured to restrict insertion of the kit housing beyond a predetermined depth in the mortise lock.

8. The mortise lock conversion kit of claim 6, further comprising at least one groove defined in the kit housing, with the groove configured to receive a fastener configured to secure the kit housing against rotation in the orifice of the mortise lock.

9. The mortise lock conversion kit of claim 6, further comprising an annular groove defined in the mortise conversion hub between the first circular end and the second end defining the rectangular portion, with the annular groove configured to engage a set screw through the kit housing, with the set screw configured to restrict longitudinal movement of the conversion hub and allow rotational movement of the conversion hub within the through bore.

10. The mortise lock conversion kit of claim 6, further comprising a pair of concave depressions defined in the mortise cam, with one concave depression on each side of the cam arm, with each concave depression configured to receive a protrusion defined by the cam-toggle when the cam arm engages the cam-toggle in the U-shaped engagement space.

* * * * *

UNITED STATES PATENT AND TRADEMARK OFFICE

CERTIFICATE OF CORRECTION

PATENT NO. : 9,169,668 B2
APPLICATION NO. : 13/617437
DATED : October 27, 2015
INVENTOR(S) : Timothy Vincent George It is certified that error appears in the above-identified patent and that said Letters Patent is hereby corrected as shown below:

ON THE TITLE PAGE

Page 1, (73) Assignee: Hopper Holding AG; change --Hopper-- to --HOPPE--

Signed and Sealed this
Eighth Day of March, 2016

Michelle K. Lee

Michelle K. Lee
*Director of the United States Patent and Trademark Office*